US012680748B2

(12) United States Patent
Tekce et al.

(10) Patent No.: US 12,680,748 B2
(45) Date of Patent: Jul. 14, 2026

(54) REFRIGERATION APPLIANCE CONTAINING A RETAINING DEVICE

(71) Applicant: BSH Hausgeräte GmbH, Munich (DE)

(72) Inventors: Veysel Tekce, Tekirdag (TR); Burak Cöp, Tekirdag (TR); Dogan Kilinc, Istanbul (TR)

(73) Assignee: BSH Hausgeräte GmbH, Munich (DE)

( * ) Notice: Subject to any disclaimer, the term of this patent is extended or adjusted under 35 U.S.C. 154(b) by 287 days.

(21) Appl. No.: 18/539,594

(22) Filed: Dec. 14, 2023

(65) Prior Publication Data

US 2024/0200850 A1 Jun. 20, 2024

(30) Foreign Application Priority Data

Dec. 14, 2022 (TR) ..... 2022/019321

(51) Int. Cl.
*F25D 21/14* (2006.01)

(52) U.S. Cl.
CPC ..... *F25D 21/14* (2013.01); *F25D 2321/143* (2013.01); *F25D 2321/1441* (2013.01)

(58) Field of Classification Search
CPC ..... F25D 21/14; F25D 2321/143; F25D 2321/1441
See application file for complete search history.

(56) References Cited

U.S. PATENT DOCUMENTS

2015/0300680 A1* 10/2015 Kroetsch ..... F24F 13/222 62/285
2017/0363335 A1* 12/2017 Arbogast ..... F25D 21/14
2020/0096249 A1* 3/2020 Lindel ..... F25D 23/006
2022/0235995 A1 7/2022 Arbogast et al.

FOREIGN PATENT DOCUMENTS

CN 1331790 A 1/2002
EP 1757878 A2 2/2007

* cited by examiner

*Primary Examiner* — Elizabeth J Martin
(74) *Attorney, Agent, or Firm* — Laurence A. Greenberg; Werner H. Stemer; Ralph E. Locher

(57) ABSTRACT

A refrigeration appliance contains a heat-insulated body, a first wall delimiting an inner space of the appliance, an evaporator assembly having an evaporator and extending in a horizontal direction of the first wall, and a retaining device configured to be connected to the evaporator. The retaining device has a base plate for collecting and discharging condensed water at a lower side of the evaporator. The retaining device further has an external sealing part attached to the base plate and arranged to at least partially encircle the base plate from outside.

17 Claims, 9 Drawing Sheets

REFRIGERATION APPLIANCE CONTAINING A RETAINING DEVICE

CROSS-REFERENCE TO RELATED APPLICATION

This application claims the priority, under 35 U.S.C. § 119, of Turkish Patent Application TR 2022/019321, filed Dec. 14, 2022; the prior application is herewith incorporated by reference in its entirety.

FIELD AND BACKGROUND OF THE INVENTION

The present invention relates to a refrigeration appliance containing a retaining device according to the preamble of the independent refrigerator appliance claim.

Refrigeration appliances, in particular a household refrigeration appliance, such as a refrigerator or a freezer, comprise retaining devices for mounting an evaporator assembly which includes an evaporator. The retaining device comprises a base plate having a condensed water channel for collecting and discharging the condensed water. The shape of the condensed water channel has a form to collect and discharge the condensed water.

U.S. patent publication No. 2022/0235995 A1 discloses a refrigeration appliance that has an inner space, an evaporator assembly extending at a wall of the inner space, a retaining device including a base plate extending between the wall and the evaporator assembly, and protrusions protruding from the wall on a first and a second edge of the base plate. At least the protrusion protruding on the first edge includes an elastic clip that can be deflected out of a position in which it engages with a first outer section of the evaporator assembly into a position in which it releases the outer section. A method for mounting an evaporator assembly on a wall of an inner space of a refrigeration appliance is also provided.

SUMMARY OF THE INVENTION

The invention provides an additional improvement, an additional advantage or an alternative to the prior art.

An object of the invention is to provide a retaining device with a leak-proof structured base plate having a more adequately formed condensed water channel.

In order to achieve the objects, the invention is a refrigeration appliance, containing a heat-insulated body, a first wall delimiting an inner space of the appliance, an evaporator assembly having an evaporator and extending in a horizontal direction of the first wall, a retaining device configured to be connected to the evaporator, having a base plate for collecting and discharging the condensed water at a lower side of the evaporator. The retaining device further contains an external sealing part attached to the base plate and arranged to at least partially encircle the base plate from outside.

Thus, the leakage of the insulation member from the body towards the inner space of the appliance is prevented in such a deeper base plate arrangement.

In this context, the term "at least partially encircle" is in particular to be understood that the sealing part may completely encircle the base plate, or the sealing part may partially encircle the base plate. There is a gap which can be provided at a region between the sealing part and the base plate.

In a possible embodiment, the sealing part contains at least one attaching means arranged to be attached to an edge of the base plate. Thus, the sealing part attaches to the base plate.

In a possible embodiment, the attaching means are hook-shaped protrusions. Thus, the sealing part attaches to the base plate via the protrusions formed integrally with the sealing part, in an easy manner. Also, a sealing part having such attaching means can be produced in a one-piece manner easily.

In a possible embodiment, the sealing part contains a front connection means for connecting the sealing part to a second wall of the refrigeration appliance which is in a plane substantially perpendicular to the first wall. Thus, the sealing part connects to the second wall for providing a leak-proof structured retaining device.

In a possible embodiment, the front connection means is a protrusion having a flat surface and extending in a direction parallel to the second wall, and a first adhesive member is provided between the front connection means and the second wall for adhesively connecting the front connection means and the second wall to each other. Thus, the sealing part connects to the second wall for providing a leak-proof structured retaining device. Moreover, the sealing part prevents possible leakages between the second wall and the retaining device.

In a possible embodiment, the front connection means extends at least along a width of the retaining device. Thus, possible leakages of the insulation member, from the region between the second wall and the retaining device are prevented along the width of the retaining device.

In a possible embodiment, the sealing part comprises a rear connection means for connecting the sealing part to the first wall. Thus, the sealing part connects to the first wall for providing a leak-proof structured retaining device.

In a possible embodiment, the rear connection means comprises two mutual connection extensions so as to define an intermediate gap which receives an end of the first wall. Thus, the sealing part connects to the first wall for providing a leak-proof structured retaining device.

In a possible embodiment, a second adhesive member is provided at a side above the second connection extension having a free end. Thus, possible leakages of the insulation member, from the region between the first wall and the retaining device are prevented, along the width of the retaining device.

In a possible embodiment, the base plate has a condensed water channel for directing the condensed water towards the through-going passage. Thus, the base plate guides the condensed water towards the through-going passage easily.

In a possible embodiment, the sealing part has a discharging pipe which corresponds to the through-going passage, when the sealing part is attached to the base plate. Thus, the condensed water can be discharged from the leak-proof structured retaining device.

In a possible embodiment, the base plate has a deepening form which deepens in a direction from the second wall towards the first wall. Thus, the base plate collects the condensed water. Moreover, the base plate is provided so as to be in a deeper level than the second wall. Such a structure of the base plate eliminates possible leakages of the condensed water from the base plate towards the inner space of the appliance.

In a possible embodiment, at least one positioning tab is provided on an upper surface of the second connection extension so as to limit the vertical movement of the rear connection means. Thus, during the mounting process of the rear connection means to the first wall, the rear connection means and the first wall can easily be positioned with respect to each other.

In a possible embodiment, a plurality of positioning tabs is provided at a first side of the second connection extension, and a plurality of positioning tabs is provided at a second side of the second connection extension which is away from the first side in the horizontal direction of the sealing part. Thus, the positioning of the rear connection means and the first wall with respect to each other is ensured in the horizontal direction of the sealing part.

In a possible embodiment, the retaining device is made from a metal material, preferably aluminum, and wherein the sealing part is made from a plastic material. Thus, the sealing part is provided so as to be deeper than the base plate of the retaining part. Such an arrangement prevents possible deformations of the base plate of the retaining part which is made from a metal material and manufactured by a bending process or a deep drawing process, during the manufacturing process of the retaining part.

In this context, with the indications "top", "bottom", "front", "rear", "horizontal", "vertical", "upward", "downward", "inner", "outer", "inward", "outward" etc. the positions and orientations given for intended use and intended arrangement of the refrigeration appliance and for a user then standing in front of the refrigeration appliance in a closed position and viewing in the direction of the appliance are indicated.

Each possible embodiment disclosed in this text can be combined with the other possible embodiments disclosed in this text if there is no technical constraint.

Other features which are considered as characteristic for the invention are set forth in the appended claims.

Although the invention is illustrated and described herein as embodied in a refrigeration appliance containing a retaining device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In this detailed description, the subject matter is explained with references to examples without forming any restrictive effect only in order to make the subject more understandable.

Figure 1:
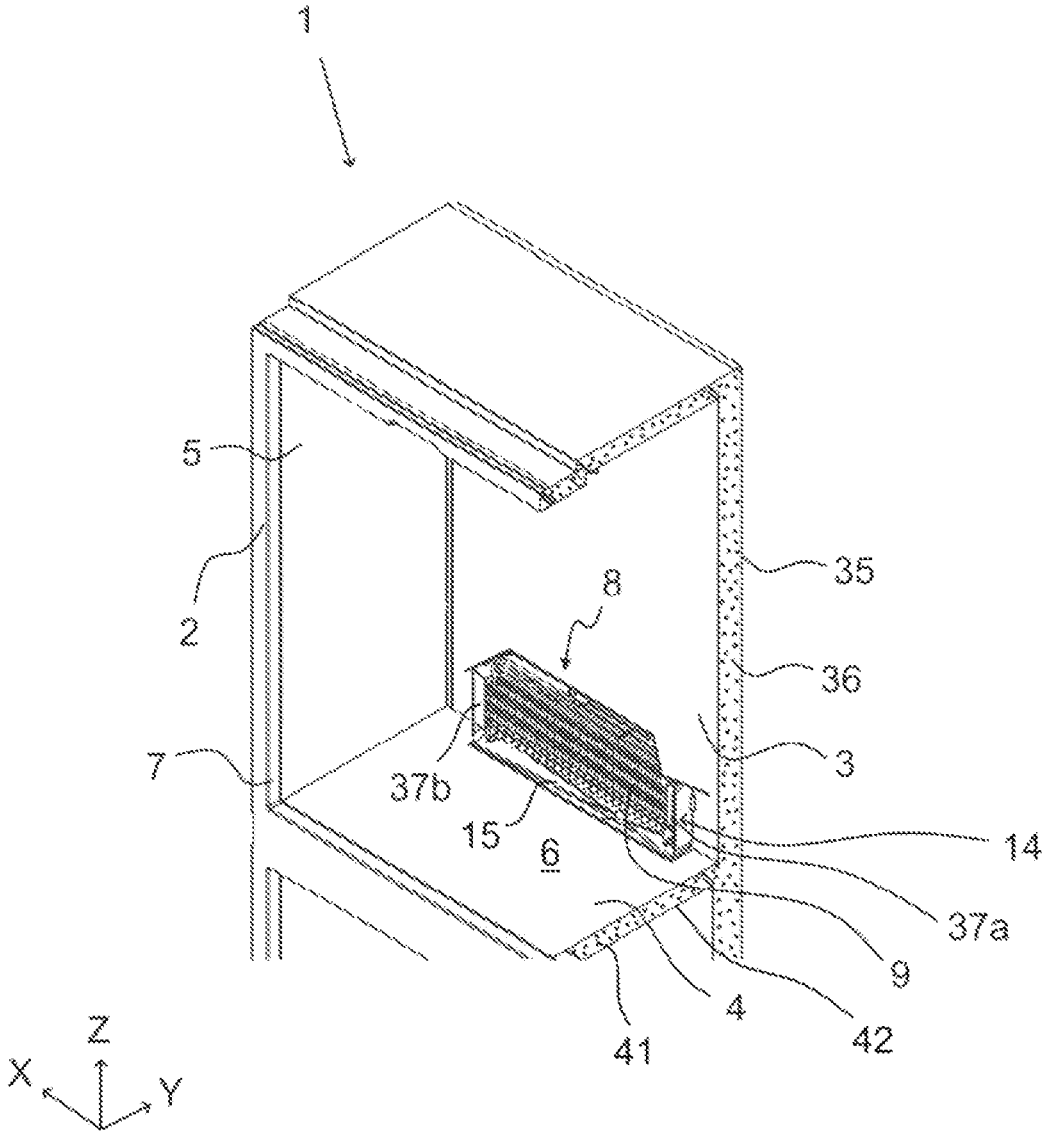
FIG. 1 is a perspective isometric view of a refrigeration appliance.

Referring now to the figures of the drawings in detail, and first, particularly to FIG. 1 thereof, there is shown a refrigeration appliance (1), in particular a household refrigeration appliance such as a refrigerator, which contains a heat-insulated body (2). The heat-insulated body (2) surrounds at least one storage compartment of the refrigeration appliance (1) where the items to be cooled can be located. The storage compartment has an access opening (7) at a front side of the appliance for accessing inner space (6). The heat-insulated body (2) includes an inner wall facing the storage compartment and an outer wall which faces outside. There is an insulation member (36) such as a polyurethane, which is provided between the outer wall and the inner wall. The inner wall can be a rear wall or sidewalls (5) facing the storage compartment. Preferably, the inner wall is being a rear wall of the refrigeration appliance (1), which is named as a first wall (3) in this context. The first wall (3) delimits an inner space (6) of the storage compartment. In this context, the outer wall is named as a third wall (35). On the other hand, the refrigeration appliance (1) further contains an intermediate wall (41) provided in a horizontal plane so as to divide the storage compartment into two sub-compartments, namely a fridge compartment and a freezer compartment. The intermediate wall (41) includes a base wall which is named as a second wall (4), and a fourth wall (42) spaced apart from the second wall (4). The insulation member (36) also fills a gap provided between the second wall (4) and the fourth wall (42). An evaporator assembly (8) is located at a side of the refrigeration appliance (1) closer to the first wall (3). In more detail, the evaporator assembly (8) is provided at a rear side of the refrigeration appliance (1). The evaporator assembly (8) has an evaporator (9) and extends in a horizontal direction (X) of the first wall (3). The evaporator (9) is a vertical evaporator which is provided parallel to the first wall (3). There is a retaining device (14) configured to be connected to the evaporator (9). The retaining device (14) comprises a base plate (15) provided at a lower side of the evaporator (9) for collecting and discharging the condensed water.

Figure 2:
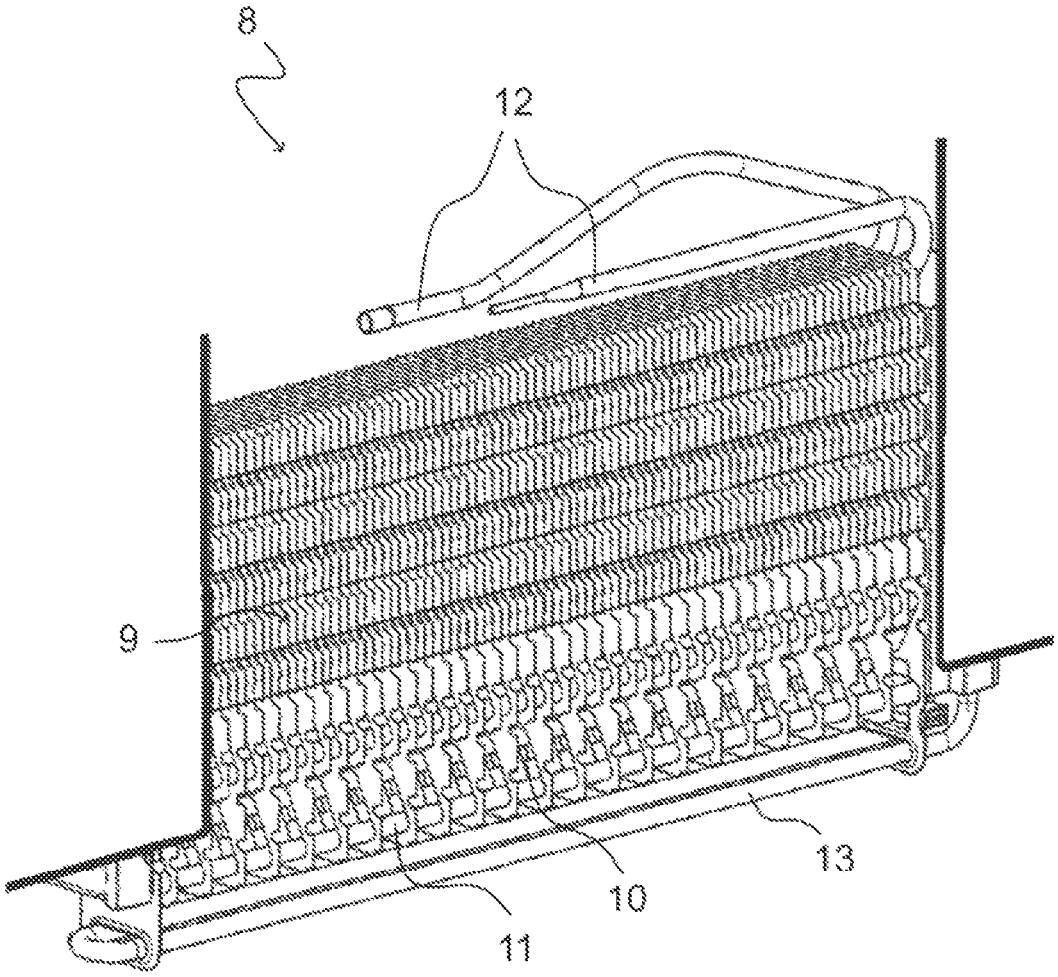
FIG. 2 is a perspective isometric view of the evaporator assembly having an evaporator heater.

FIG. 2 illustrates the evaporator assembly (8) of the refrigeration appliance (1) from the rear side. The evaporator assembly (8) is formed by means of an evaporator (9), in this case a fin evaporator. The evaporator (9) contains in a manner known per se a plurality of mutually parallel fins (10) and a refrigerant tube (11) that extends in a meandering manner through openings of the fins (10), wherein tube loops of the refrigerant tube (11) protrude beyond the outer fins. End pieces (12) of the refrigerant tube (11) that are still unconnected and are to be inserted into a refrigerant circuit of the refrigeration appliance (1) extend beyond the block of fins (10). An evaporator heater (13), in this case in the form of a tube that is bent in the shape of a hair pin and contains an electrical heating resistor, extends below the evaporator (9). The evaporator heater (13) is used in a manner known per se for defrosting white frost that during the operation precipitates on the evaporator (9) as a result of radiation and rising warm air.

Figure 5:
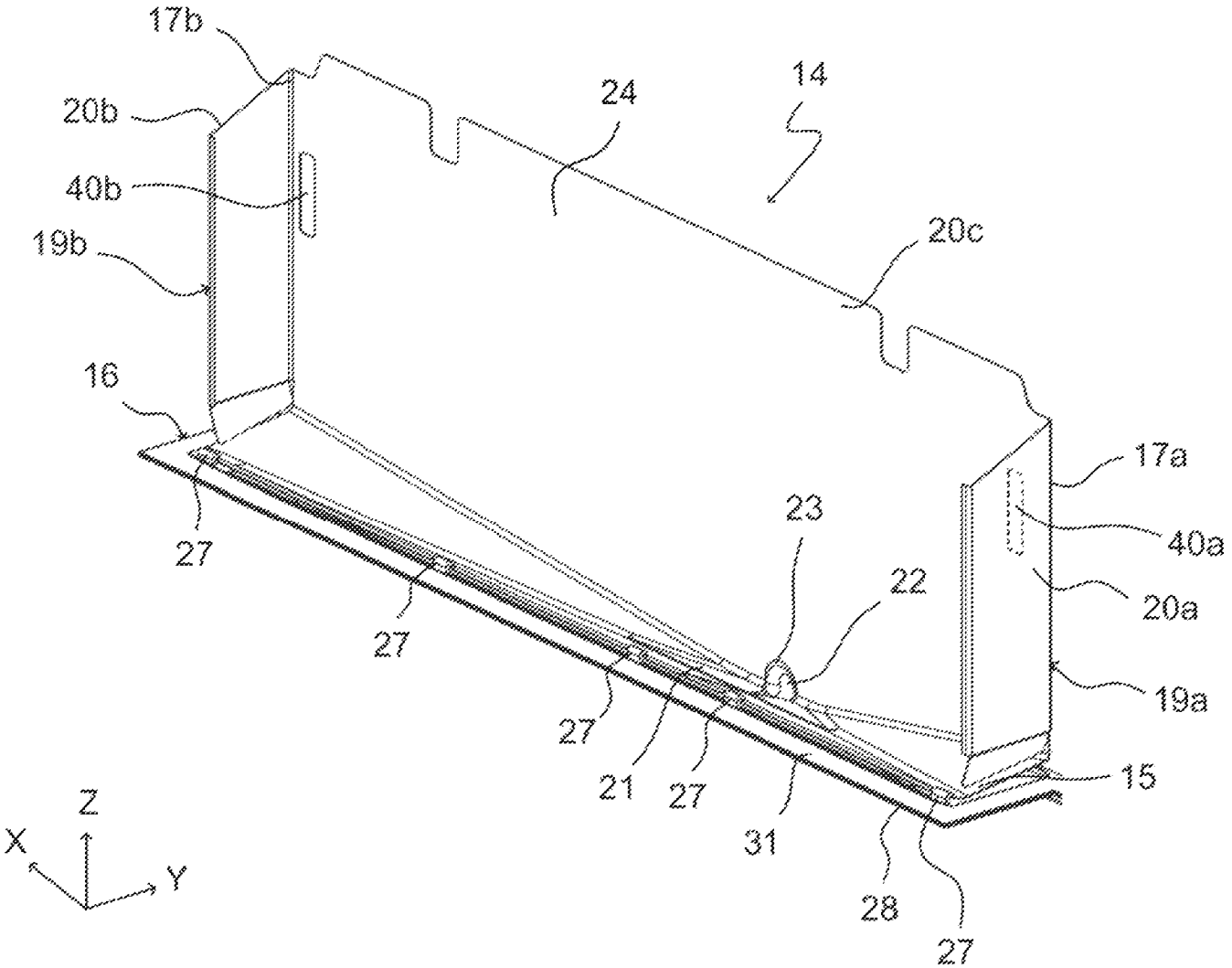
FIG. 5 is a perspective view of the retaining device with the sealing part from the front side.

With reference to FIGS. 1 and 2, two bypass blockers (37*a*, 37*b*) that form the outer sections of the evaporator assembly (8) are attached to the outer fins lying on both sides of the evaporator (9). In more detail, a first bypass blocker (37*a*) is located on a right side of the evaporator (9), and a second bypass blocker (37*b*) is located on a left side of the evaporator (9) which is opposite the right side. The respective protruding tube loops of the evaporator (9) engage in the recesses of the respective bypass blockers (37*a*, 37*b*) (not shown in FIGS. 1-3). The bypass blockers (37*a*, 37*b*) are shaped bodies embodied from a closed-pore synthetic material foam, typically from expanded polystyrene. As can be seen in FIG. 5, the retaining device (14) has connection holes (40*a*, 40*b*) which correspond to the bypass blockers (37*a*, 37*b*) for fixing the bypass blockers (37*a*, 37*b*) to the retaining part (14). In more detail, the first connection hole (40*a*) corresponds to the first bypass blocker (37*a*), and similarly, the second connection hole (40*b*) corresponds to the second bypass blocker (37*b*).

Figure 3:
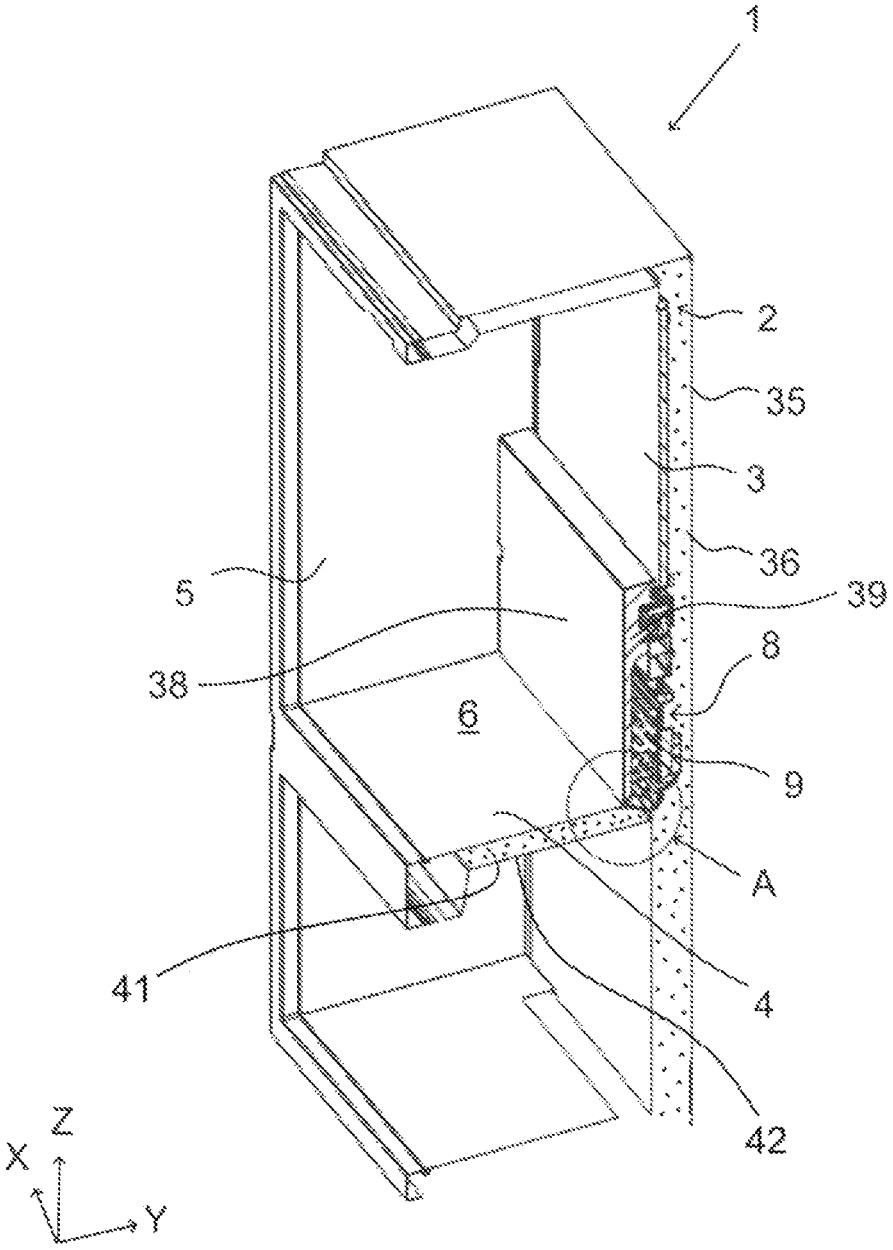
FIG. 3 is another perspective isometric view of the refrigeration appliance.

As can be seen in FIG. 3, there is a front cover (38) positioned at a front side of the evaporator assembly (8) so as to cover the evaporator assembly (8). The front cover extends in a horizontal direction (X) of the storage compartment. A space provided between the evaporator (9) and the front cover (38), can be filled by an isolation member (39), such as an expanded polystyrene foam (EPS), in order to prevent possible condensation from occurring on the front cover (38).

Figure 4:
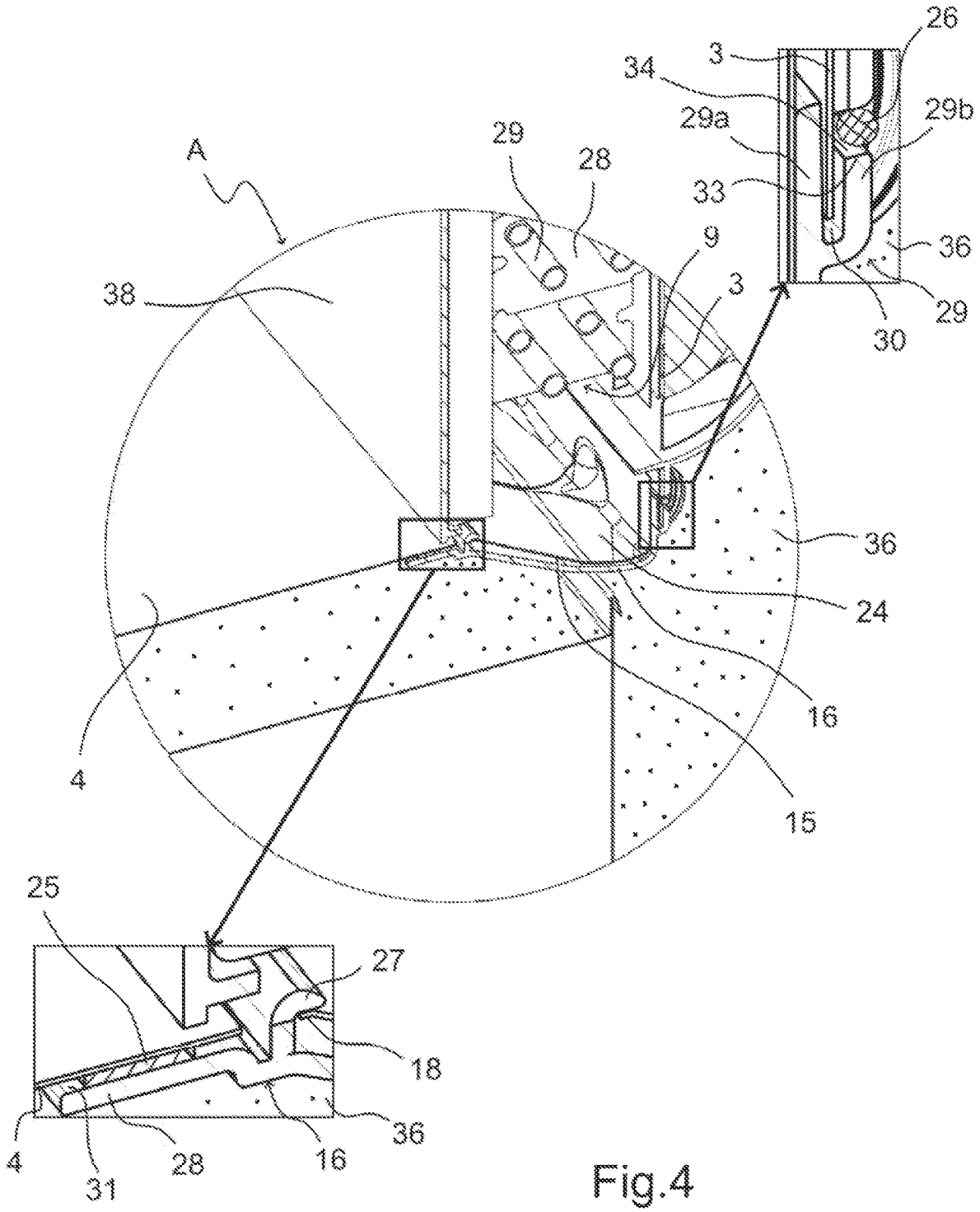
FIG. 4 is a zoomed perspective view of a region of the refrigeration appliance where a retaining device with a sealing part is provided and the zoomed views of the regions where front connections means and rear connection means of the sealing part are provided.
Figure 9:
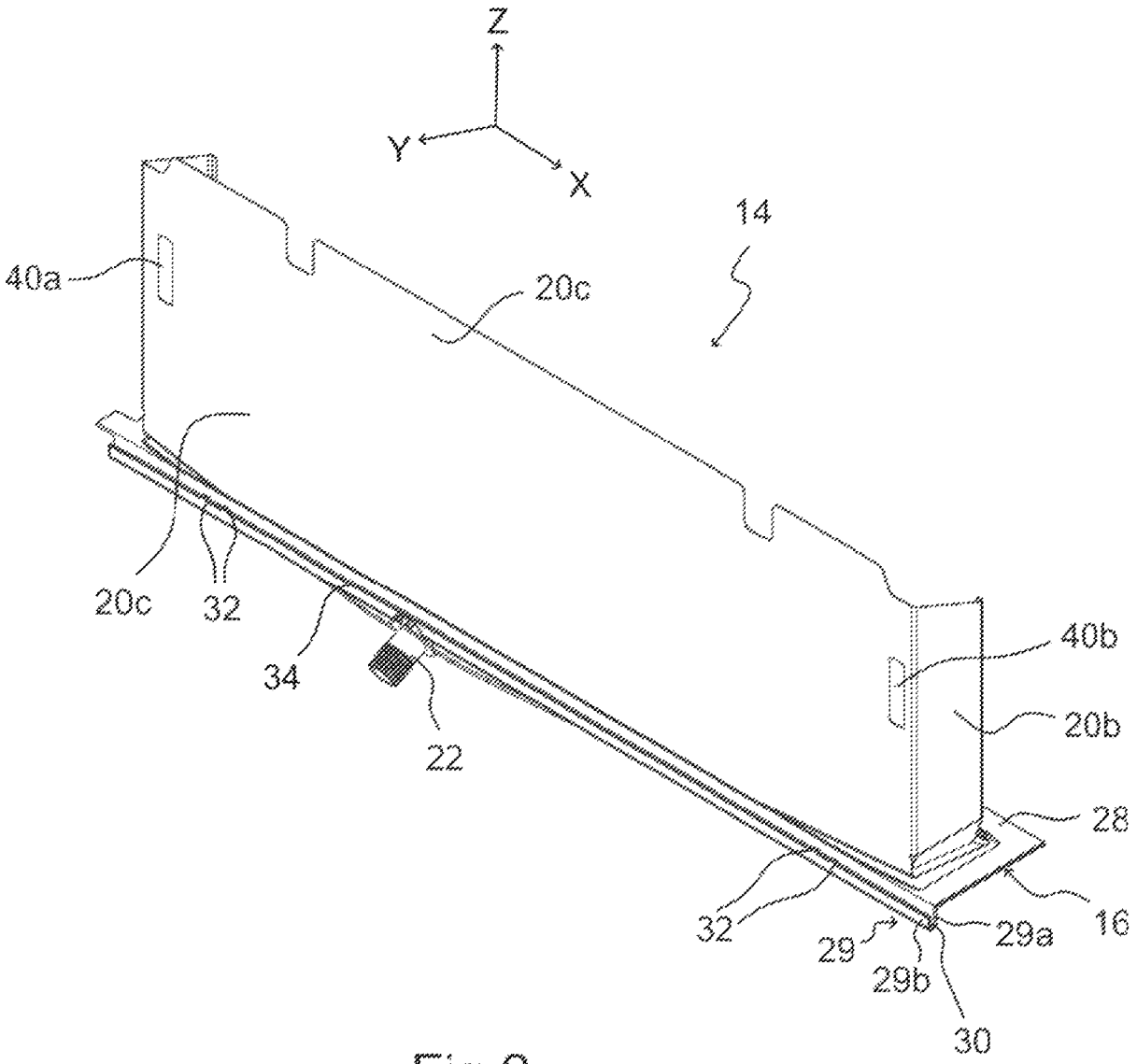
FIG. 9 is a perspective isometric view of the retaining device with the sealing part from rear side.

With reference to FIG. 4 which shows detail A (A), in a possible embodiment, the retaining device (14) contains an external sealing part (16) attached to the base plate (15). The sealing part (16) is arranged to at least partially encircle the base plate (15) from outside. The sealing part (16) faces the insulation member (36) of the heat-insulated body (2). The sealing part (16) is formed according to the shape and size of the base plate (15). The sealing part (16) comprises at least one attaching means (27) arranged to be attached to an edge of the base plate (15). Preferably, the sealing part (16) attaches to a front edge of the base plate (15) which is closer to the front cover (38). The front edge (18) is an edge of the base plate (15) that extends in a horizontal direction (X) of the base plate (15). The sealing part (16) comprises a front connection means (28) for connecting the sealing part (16) to the second wall (4) which is in a plane substantially perpendicular to the first wall (3). In a possible embodiment, the front connection means (28) is being a protrusion having a flat surface (31). The front connection means (28) extends in a direction parallel to the second wall (4). A first adhesive member (25), such as a double-sided tape or a silicone element is provided between the front connection means (28) and the second wall (4) for adhesively connecting the front connection means (28) and the second wall (4) to each other. On the other hand, the sealing part (16) further comprises a rear connection means (29) for connecting the sealing part (16) to the first wall (3). The rear connection means (29) comprises two mutual connection extensions (29*a*, 29*b*). The connection extensions (20*a*, 29*b*) define an intermediate gap (30) which receives an end of the first wall (3). In more detail, the rear connection means (29) comprises a first connection extension (29*a*) abutting to a wall of the base plate (15) and a second connection extension (29*b*) spaced apart from the first connection extension (29*a*). As can be seen in FIG. 9, the connection extensions (29*a*, 29*b*) extend at least along the horizontal direction (X) of the retaining device (14). Preferably, the second connection extension (29*a*) having a free end (33) is shorter than the first connection extension (29*a*). In a possible embodiment, a second adhesive member (26), such as a double sided tape or a silicone element, is provided at a side above the second connection extension (29*b*). Thus, possible leakages of the insulation member (36) are eliminated.

Figure 7:
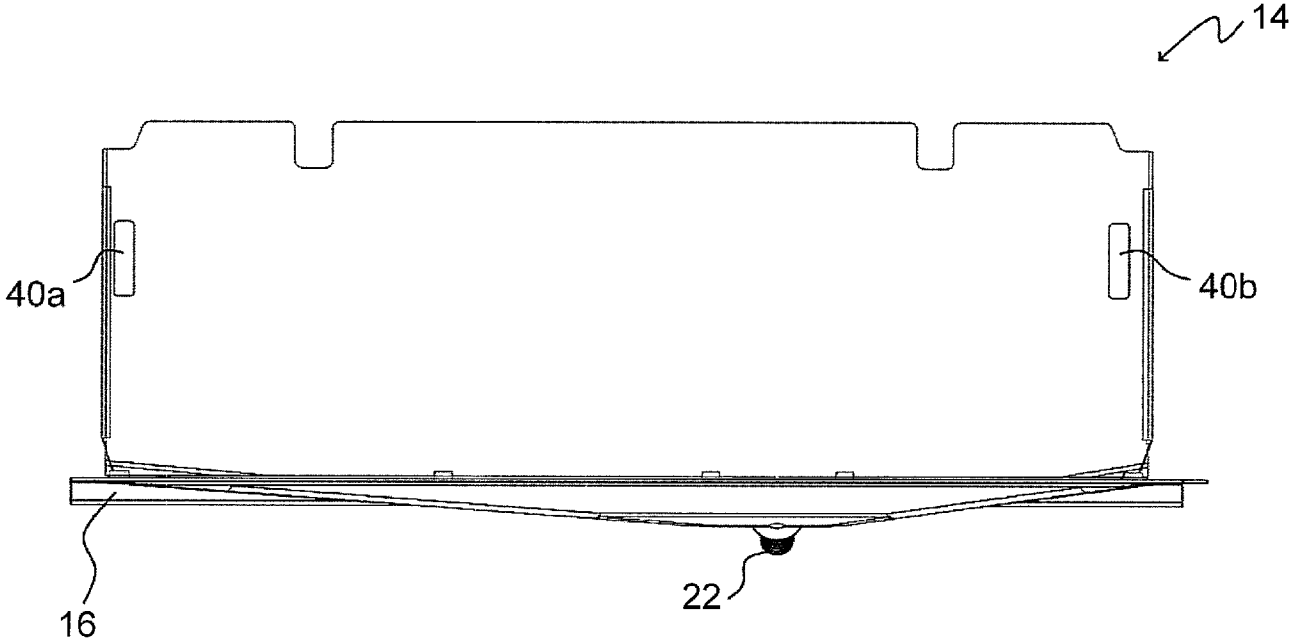
FIG. 7 is a top view of the retaining device with the sealing part.

FIG. 5 illustrates the retaining device (14) with the sealing part (16), when the sealing part (16) is attached to the base plate (15) of the retaining device (14). The retaining device (14) can be formed as one piece from a section of the sheet metal. The retaining device (14) has a substantially rectangular third wall plate (20*c*) which can lie against a wall, in particular a rear wall of the inner space (6), in a mounted state. The section is bent over on two edges (17*a*, 17*b*) of the third wall plate (20*c*) in order to form the protrusions (19*a*, 19*b*). The edges (17*a*, 17*b*) are oriented in a vertical manner when the refrigeration appliance (1) is finished and set upright in the position of use. The first protrusion (19*a*) comprises a first wall plate (20*a*) that extends over a major part of the first edge (17*a*). Similarly, the second protrusion (19*b*) comprises a second wall plate (20*b*) that extends over a major part of the second edge (17*b*). The protrusions are formed so as to define recesses in order to receive corresponding bypass blockers (37*a*, 37*b*). The evaporator (9) is inserted into the inner space of the retaining device (24) in an inclined position, and its bypass blockers (37*a*, 37*b*) are placed in the corresponding recesses of the protrusions (19*a*, 19*b*). Subsequently, the evaporator assembly (8) is pivoted against the third wall plate (20*c*) about the axis that is determined by means of the bypass blockers (37*a*, 37*b*) engaging the corresponding recesses. As a consequence, the connection protrusions (not shown) of the bypass blockers (37*a*, 37*b*) attach to the corresponding connection holes (40*a*, 40*b*) of the third wall plate (20*c*). On the other hand, a condensed water channel (21) is formed on the base plate (15) of the retaining device (14), the base plate (15) being the lower plate after the retaining device (14) has been installed in the finished refrigeration appliance. The condensed water channel (21) slopes towards the middle from its two ends on the edges (17*a*, 17*b*) and comprises a through-going passage (23) at its deepest point. As can be seen in FIG. 5, in this case, the through-going passage (23) is located at a side of the base plate (15) closer to the third wall plate (20*c*). Thus, the base plate (15) guides the condensed water towards the through-going passage (23). As can be seen in FIGS. 7 and 9, the sealing part (16) has a discharging pipe (22) which corresponds to the through-going passage (23), when the sealing part (16) is attached to the base plate (15). The discharging pipe (22) can have an outer surface, and at least a portion of the outer surface can have a threaded region. A discharging hose (not shown) connects to the discharging pipe (22) in order to carry the condensed water to an evaporation tray (not shown) of the appliance. In a possible embodiment of the invention, the sealing part (16) has a plurality of attaching means (27). In this case, the sealing part (16) has five attaching means (27). The attaching means (27) are being a hook-shaped protrusions for hanging the sealing part (16) to the front edge (18). On the other hand, the front connection means (28) having a flat surface (31), extends in the horizontal direction (X) of the retaining device (14). Preferably, the front connection means (28) extends at least along a width of the retaining device (14). More preferably, the front connection means (28) also extends in a depth direction (Y) of the retaining device (14) at both left and right sides of the retaining device (14). In such an arrangement, the first adhesive element (25) on both parts of the front connection means (28) extends in the horizontal direction (X) and the depth direction (Y).

Figure 6:
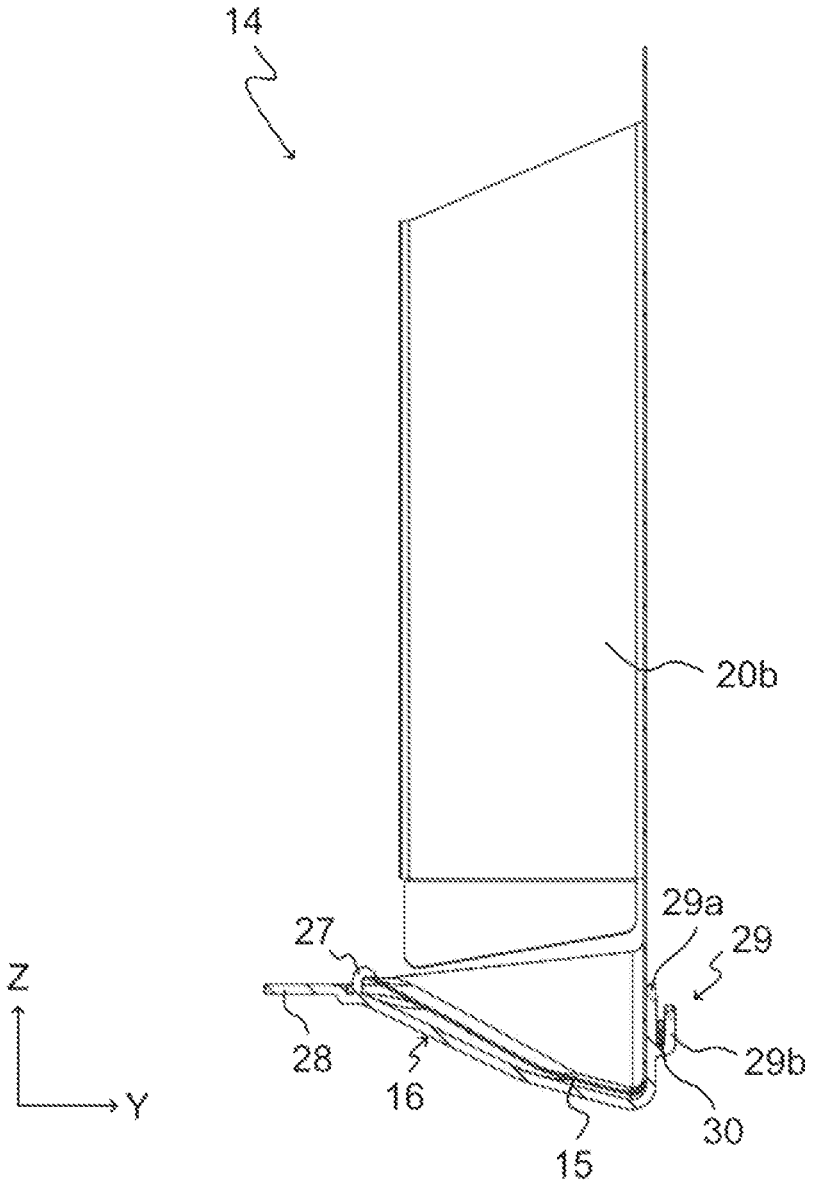
FIG. 6 is a cross-sectional side view of the retaining device with the sealing part.

With reference to FIG. 6, the base plate (15) has a deepening form which deepens in a direction from the second wall (4) towards the first wall (3). In other words, the base plate (15) deepens in the depth direction (Y). The sealing part (16) has a form according to shape and size of the base plate (15) so as to at least partially encircle the base plate (15). The front connection means (28) having the flat surface (31) for connecting the sealing part (16) to the second wall (4), is located at a higher side of the sealing part (16) in a vertical direction (H). With such an arrangement, the condensed water can be collected on the lower side with respect to the location of the second wall (4). Thus, the possible water leakages from the base plate (15) towards the second wall (4) are eliminated.

Figure 8:
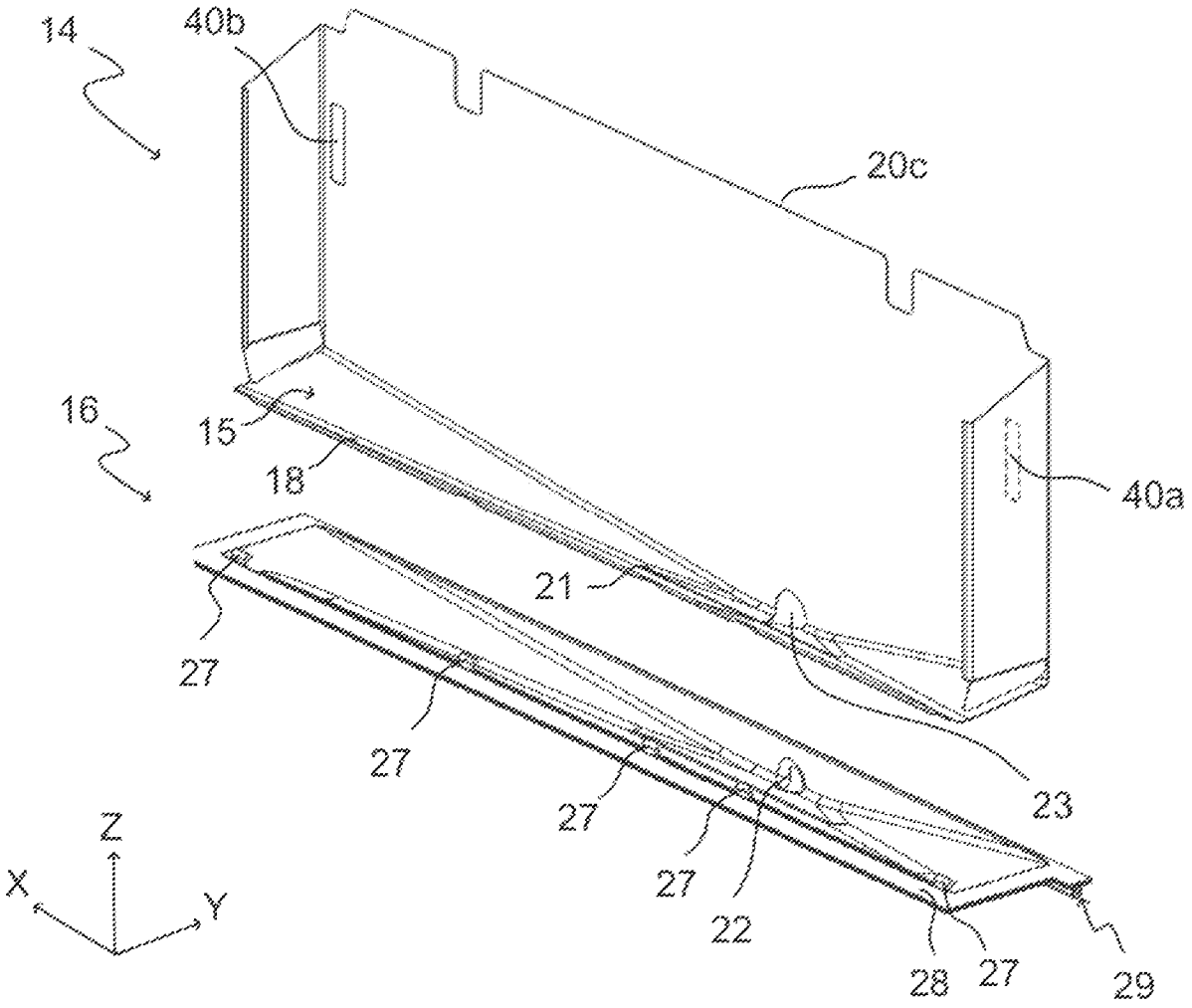
FIG. 8 is an exploded, perspective view of the retaining device and the external sealing part.

With reference to FIG. 8, the sealing part (16) attaches to the retaining part (14), when the sealing part (16) is moved towards the retaining device and attached to the front edge of the base plate (15). Furthermore, when the rear side of the sealing part (16) is moved vertically, the intermediate gap (30) receives the end of the first wall (3). In a possible embodiment, as can be seen in FIG. 9, at least one positioning tab (32) is provided on an upper surface (34) of the second connection extension (29*b*) so as to limit a vertical movement of the rear connection means (29), during the vertical movement of the sealing part (16). Preferably, a plurality of positioning tabs (32) is provided at a first side of the second connection extension (29*b*), and a plurality of positioning tabs (32) is provided at a second side of the second connection extension (29*b*) which is away from the first side in the horizontal direction (X) of the sealing part (16). When the sealing part (16) is moved vertically, the positioning tabs (32) correspond to the positioning recesses (not shown) of the first wall (3). Thus, the positioning of the rear connection means (29) and the first wall (3) with respect to each other is ensured in the horizontal direction (X) of the sealing part (16). On the other hand, at the front side, the sealing part (16) attaches to the second wall (4) by means of the first adhesive member (25).

In the invention, the first wall (3) and the second wall (4) are made from a metal material, preferably stainless steel material. The retaining device (14) is made from a metal material, preferably aluminum, and formed by bending a sheet metal material. In a possible embodiment, the sealing part (16) is made from a plastic material which is selected from the group of the sealing acrylonitrile butadiene styrene (ABS), polystyrene (PS) or polypropylene (PP). Alternatively, the sealing part (16) can also be made from an elastic material, such as a rubber material.

The following is a summary list of reference numerals and the corresponding structure used in the above description of the invention.

REFERENCE LIST

1 Refrigeration appliance
2 Heat-insulated body
3 First wall
4 Second wall
5 Sidewall
6 Inner space
7 Access opening
8 Evaporator assembly
9 Evaporator
10 Fins
11 Refrigerant tube
12 End pieces
13 Evaporator heater
14 Retaining device
15 Base plate
16 Sealing part
17*a* First edge
17*b* Second edge
18 Front edge
19*a* First protrusion
19*b* Second protrusion
20*a* First wall plate
20*b* Second wall plate
20*c* Third wall plate
21 Condensed water channel
22 Discharging pipe
23 Through-going passage
24 Inner space of the retaining device
25 First adhesive member
26 Second adhesive member
27 Attaching means
28 Front connection means
29 Rear connection means
29*a* First connection extension
29*b* Second connection extension
30 Intermediate gap
31 Flat surface
32 Positioning tab
33 Free end
34 Upper surface
35 Third wall
36 Insulation member
37*a* First bypass blocker
37*b* Second bypass blocker
38 Front cover
39 Isolation member
40*a* First connection hole
40*b* Second connection hole
41 Intermediate wall
42 Fourth wall
A Detail A
X Horizontal direction
Y Depth direction
Z Vertical direction

The invention claimed is:

1. A refrigeration appliance, comprising:

a heat-insulated body having a first wall delimiting an inner space of the refrigeration appliance and a second wall being in a plane substantially perpendicular to said first wall;

an evaporator assembly having an evaporator and extending in a horizontal direction of said first wall; and a retaining device connected to said evaporator, said retaining device having a base plate for collecting and discharging condensed water at a lower side of said evaporator, said retaining device further having an external sealing part attached to said base plate and disposed to at least partially surround said base plate, said external sealing part containing a front connection means connecting said external sealing part to said second wall, and said base plate deepens continuously from said second wall to said first wall.

2. The refrigeration appliance according to claim 1, wherein said sealing part has at least one attaching means attached to an edge of said base plate.

3. The refrigeration appliance according to claim 2, wherein said at least one attaching means has hook-shaped protrusions.

4. The refrigeration appliance according to claim 1, wherein said sealing part contains a rear connection means for connecting said sealing part to said first wall.

5. The refrigeration appliance according to claim 4, wherein said rear connection means contains two mutual connection extensions so as to define an intermediate gap between said two mutual connection extensions which receives an end of said first wall.

6. The refrigeration appliance according to claim 5, further comprising a second adhesive member disposed at a side above a connection extension having a free end of said two mutual connection extensions.

7. The refrigeration appliance according to claim 6, further comprising at least one positioning tab disposed on an upper surface of said connection extension so as to limit a vertical movement of said rear connection means.

8. The refrigeration appliance according to claim 7, further comprising:

a plurality of positioning tabs disposed at a first side of said connection extension; and a plurality of further positioning tabs disposed at a second side of said connection extension which is away from said first side in a horizontal direction of said sealing part.

9. The refrigeration appliance according to claim 1, wherein said base plate has a condensed water channel for directing the condensed water towards a through-going passage of said condensed water channel.

10. The refrigeration appliance according to claim 9, wherein said sealing part has a discharging pipe which corresponds to said through-going passage, when said sealing part is attached to said base plate.

11. The refrigeration appliance according to claim 1, wherein said retaining device is made from a metal material and wherein said sealing part is made from a plastic material.

12. The refrigeration appliance according to claim 11, wherein said metal material is aluminum.

13. A refrigeration appliance, comprising:

a heat-insulated body having a first wall delimiting an inner space of the refrigeration appliance;

an evaporator assembly having an evaporator and extending in a horizontal direction of said first wall; and a retaining device being connected to said evaporator, said retaining device having a base plate for collecting and discharging condensed water at a lower side of said evaporator, said retaining device further having an external sealing part attached to said base plate and disposed to at least partially surround said base plate, said external sealing part containing a rear connection means for connecting said external sealing part to said first wall, wherein said rear connection means contains two mutual connection extensions so as to define an intermediate gap between said two mutual connection extensions which receives an end of said first wall.

14. The refrigeration appliance according to claim 13, wherein:

said heat-insulated body has a second wall which is in a plane substantially perpendicular to said first wall; and said sealing part contains a front connection means for connecting said sealing part to said second wall.

15. The refrigeration appliance according to claim 14, wherein said front connection means is a protrusion having a flat surface and extending in a direction parallel to said second wall; and further comprising a first adhesive member disposed between said front connection means and said second wall for adhesively connecting said front connection means and said second wall to each other.

16. The refrigeration appliance according to claim 15, wherein said front connection means extends at least along a width of said retaining device.

17. A refrigeration appliance, comprising:

a heat-insulated body having a first wall delimiting an inner space of the refrigeration appliance;

an evaporator assembly having an evaporator and extending in a horizontal direction of said first wall; and a retaining device being connected to said evaporator, said retaining device having a base plate for collecting and discharging condensed water at a lower side of said evaporator, said retaining device further having an external sealing part attached to said base plate and disposed to at least partially surround said base plate, said base plate having a condensed water channel for directing the condensed water towards a through-going passage of said condensed water channel, wherein said external sealing part has a discharging pipe which corresponds to said through-going passage, when said sealing part is attached to said base plate.

* * * * *